US008484915B1

(12) United States Patent
Abbas et al.

(10) Patent No.: US 8,484,915 B1
(45) Date of Patent: Jul. 16, 2013

(54) SYSTEM FOR IMPROVING FIRE ENDURANCE OF CONCRETE-FILLED STEEL TUBULAR COLUMNS

(75) Inventors: Husain Abbas, Riyadh (SA); Yousef A. Al-Salloum, Riyadh (SA); Saleh H. Alsayed, Riyadh (SA); Mohammed S. Alhaddad, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 13/546,502

(22) Filed: Jul. 11, 2012

(51) Int. Cl.
*E04C 5/08* (2006.01)

(52) U.S. Cl.
USPC ..... 52/223.4; 52/223.5; 52/244; 52/295; 52/296; 52/673; 52/302.5; 52/321; 52/843; 52/834; 405/244; 405/232

(58) Field of Classification Search
USPC ..... 52/292, 294, 295, 296, 297, 244, 52/651.05, 673, 223.4, 223.5, 302.5, 302.3, 52/321, 322, 340, 831, 843, 834, 309.16; 405/244, 256, 229, 231, 232, 248; 248/679, 248/530, 156
See application file for complete search history.

(56) References Cited

U.S. PATENT DOCUMENTS

| | | | | | |
|---|---|---|---|---|---|
| 2,176,007 | A * | 10/1939 | Heanue | 52/283 |
| 3,616,583 | A | 11/1971 | Weineck et al. | |
| 3,798,867 | A * | 3/1974 | Starling | 52/834 |
| 4,122,646 | A * | 10/1978 | Sapp | 52/651.05 |
| 4,232,846 | A * | 11/1980 | Bressani | 248/158 |
| 4,407,107 | A * | 10/1983 | Smith, Jr. | 53/528 |
| 4,571,913 | A | 2/1986 | Schleich et al. | |
| 4,722,156 | A | 2/1988 | Sato | |
| 4,779,395 | A | 10/1988 | Schleich et al. | |
| 5,174,080 | A * | 12/1992 | Yoshimura et al. | 52/252 |
| 6,061,992 | A | 5/2000 | Vincent | |
| 7,823,347 | B1 * | 11/2010 | Blinn | 52/244 |
| 8,109,057 | B2 * | 2/2012 | Stark | 52/297 |
| 2008/0196341 | A1 * | 8/2008 | Kang et al. | 52/292 |

FOREIGN PATENT DOCUMENTS

| | | | |
|---|---|---|---|
| JP | 406129056 | A | 5/1994 |
| JP | 410204993 | A | 8/1998 |
| JP | 410204995 | A | 8/1998 |
| JP | 2001279865 | A | 10/2001 |
| JP | 2002013225 | A | 1/2002 |
| KR | 2007041023 | A | 4/2007 |
| KR | 951646 | B1 | 4/2010 |
| TW | 322523 | A | 12/1997 |

* cited by examiner

*Primary Examiner* — Chi Q Nguyen
(74) *Attorney, Agent, or Firm* — Lowe Hauptman Ham & Berner, LLP

(57) ABSTRACT

A concrete filled tubular steel column includes a longitudinally extending vertical tubular steel shell and an inner tubular steel member disposed at the center of the steel shell. A plurality of spaced vertical steel plates extend from the inner members toward but not abutting the steel shell. In addition a plurality of horizontally disposed perforated pipes extend outwardly from the inner member and have a plurality of meltable polymer plugs or caps to prevent plastic cement from flowing into or closing the openings. In the event of fire the plastic or polymer plugs or caps melt and allow gases and smoke to flow into the pipes and up through the inner member and out therefrom at the top of the column.

20 Claims, 5 Drawing Sheets

SYSTEM FOR IMPROVING FIRE ENDURANCE OF CONCRETE-FILLED STEEL TUBULAR COLUMNS

FIELD OF THE INVENTION

This invention relates to concrete-filled steel tubular columns for high load carrying capacity and more particularly to concrete-filled steel tubular columns which are resistant to fire.

BACKGROUND FOR THE INVENTION

Concrete-filled steel tubular columns are today a preferred choice of designers for high load carrying capacity per unit area of cross section of columns. Such columns provide faster construction and no requirement for framework. Patents are available giving descriptions of the methods of construction of such columns and cantilevers. However, the problem associated with this type of construction is in the escape of gases during exposure to relatively intense fires especially when the columns are massive.

This problem is exacerbated with the use of high strength concrete because of the reduced porosity thus providing fewer escape routes for gases during fire exposure. The mixing of polypropelene fibers in the concrete of such members helps to provide passage because of the fibers melting during the fire produce porosity for the escape of gases from inside the concrete mass. However, the mixing of polypropelene fibers in concrete will not be that effective because of the requirement of a large number of vents required in the steel tube which is not structurally feasible.

The exposure of such columns to fire may even lead to its bursting in the case of insufficient vents for the escape of gases. Most of the currently available studies use vents in the outer steel column for the escape of gases. A patent search on concrete filled steel tube columns disclosed the following patents.

A U.S. Patent of Sato U.S. Pat. No. 4,722,156 is entitled CONCRETE FILLED STEEL TUBE COLUMN AND METHOD OF CONSTRUCTING THE SAME. As disclosed, a concrete filled steel tube column includes a steel tube having an inner face; a concrete core disposed within the steel tube; and a separating layer interposed between the inner face of the steel tube and the concrete core for separating the concrete core from the inner face of the steel tube. Therefore, the steel tube is not bonded to the concrete core. After the separating layer is formed on the inner face of the steel tube, the concrete is charged into the steel tube to form a concrete core.

A further U.S. Patent of Schleich et al. U.S. Pat. No. 4,779,395 discloses a COMPOSITE CONCRETE/STEEL FIREPROOF COLUMN. As disclosed, a fireproof construction element has a plurality of integrally interconnected and parallel profile beams each having a longitudinally extending outer flange defining an outer surface and a longitudinally extending web extending inwardly from the flange. The webs are each formed adjacent the flange with a row of at least generally longitudinally extending, elongated, and laterally throughgoing slots. The beams form a plurality of outwardly open channels laterally bounded by the flanges. Respective masses of concrete substantially fill the channels between the webs and inward of the flanges and have outer surfaces contiguous with the outer surfaces of the beam flanges. The slots can be provided in two rows with the slots of one row overlapping and staggered with the rows of the other.

Finally, a U.S. Patent of Vincent U.S. Pat. No. 6,061,992 discloses a Composite Steel/Concrete Column comprising a longitudinally extending H-shaped steel assembly having a pair of parallel flange plates and a web plate interconnecting the flange plates and defining two opposite channel-shaped spaces. A plurality of spaced-apart transversal tie bars are disposed along the steel assembly on each side of the web plate for interconnecting the flange plates. A mass of concrete fills the channel-shaped spaces. The steel concrete column is characterized in that the ratio of the cross-sectional surface area of the steel assembly with respect to the total surface area of the composite steel/concrete column is less than 9%, preferably 2% to 5%. The column is principally to be utilized in structural steel high-rise buildings which have the advantage of shop prefabrication resulting in rapid on site construction. The column shows a steel to concrete ratio greatly reduced as compared to prior art composite columns, thereby greatly reducing the production cost and the size of the columns.

Notwithstanding the above, it is presently believed that there is a need and a potentially large commercial market for improved concrete-filled tubular steel columns for high load carrying capacity. It is also believed that the steel tubular columns for high load carrying capacity in accordance with the present invention can be produced at a competitive cost and yet possess the physical properties required in the building industry. Further, it is believed that if a fire is encountered, there are methods for retrofitting the columns at a reasonable cost.

BRIEF SUMMARY OF THE INVENTION

In essence, the present invention comprises or consists of an outer longitudinally extending vertical tubular steel shell and an inner steel member disposed within the outer longitudinally extending vertical tubular shell. In a preferred embodiment of the invention, the inner steel member is a perforated tubular element that is considerably smaller than the outer steel shell and is centrally disposed within the longitudinally outwardly vertical tubular shell. The column also includes a plurality of equally or unequally spaced transverse flanges extending outwardly from the inner steel member and a plurality of horizontally disposed perforated pipes adjacent each of the flanges at regularly vertical spacings between the outer shell and the inner steel member for the escape of gases in the event of fire.

In a preferred embodiment of the invention, the concrete-filled steel tubular column in accordance with the invention comprises an outer longitudinally extending vertical tubular steel shell and an inner perforated tubular steel member having a plurality of openings therein centrally disposed within the outer longitudinally extending tubular steel shell. In addition, a plurality preferably four radially extending vertical flanges extend outwardly from said inner tubular steel member between the inner steel member and the outer longitudinally extending vertical tubular steel shell. In addition, a plurality of horizontal perforated pipes having a plurality of openings therein are disposed at regular vertical spacings between the inner perforated steel member and the outer longitudinally extending vertical tubular steel shell for the escape of gases in the event of fire. A mass of concrete engulfs the flanges and pipes and fills the void between the outer longitudinally extending vertical tubular steel shell and the inner perforated tubular steel member. In a preferred embodiment of the invention, a mass of concrete is high strength concrete.

The invention will now be described in connection with the following figures wherein like reference numerals have been used to identify like parts.

Figure 3:
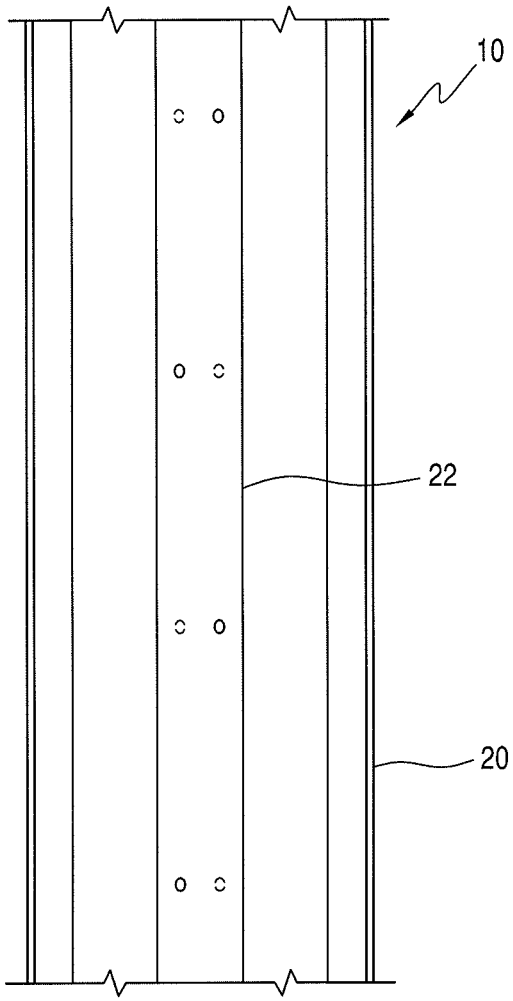
FIG. 3 is a cross sectional view of a smaller diameter circular column without flanges or perforated horizontal pipes illustrating a plurality of apertures in the inner vertical tubular member.
Figure 3A:
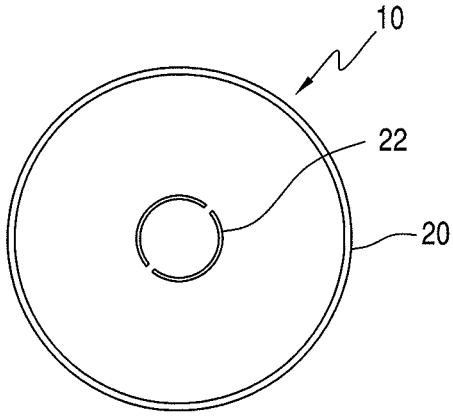
Figure 4:
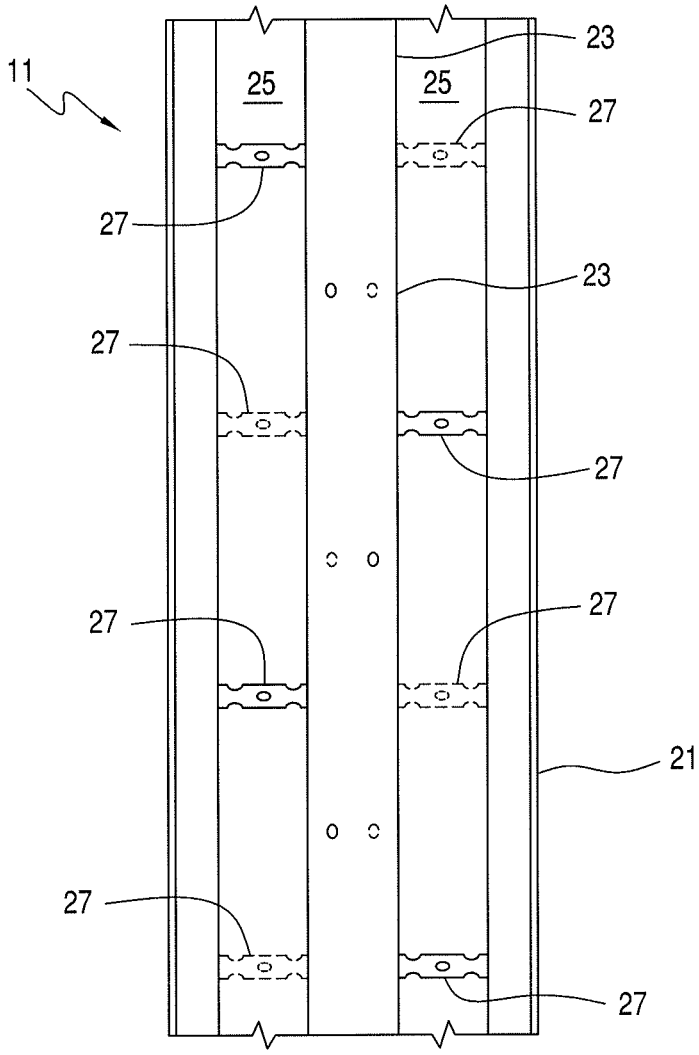
Figure 4A:
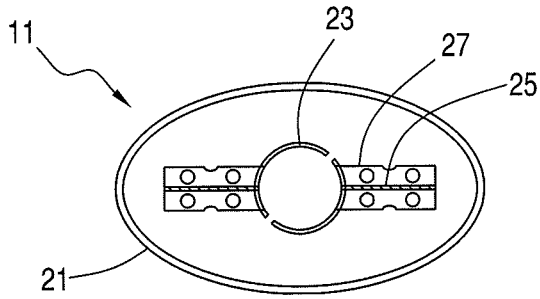
Figure 5:
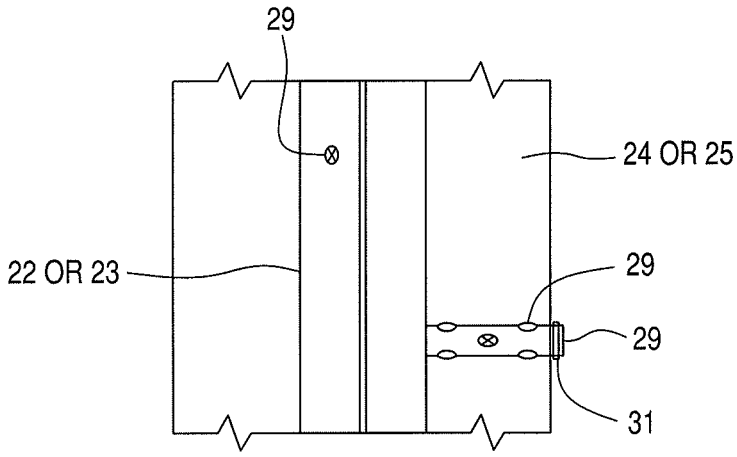
Figure 6:
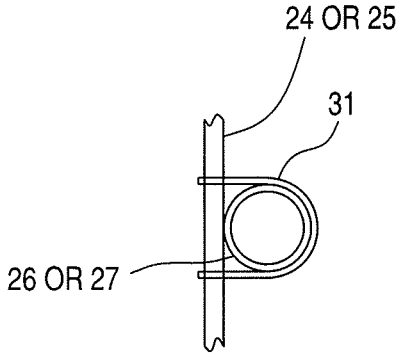

As FIG. 3A is a top or plan view of the circular concrete-filled tubular steel column shown in FIG. 3;

FIG. 4 is a cross sectional view of a tubular steel concrete-filled elliptical column in accordance with a second embodiment of the invention;

FIG. 4A is a top or plan view of the embodiment of the invention shown in FIG. 4;

FIG. 5 is a schematic illustration of the plastic plugs for closing the apertures in the inner vertical tubular member and horizontal pipes and in end caps for one of the horizontal pipes; and FIG. 6 is a schematic illustration of an attachment for fixing a horizontal pipe to a flange.

DESCRIPTION OF THE PREFERRED EMBODIMENTS OF THE INVENTION

Figure 1:
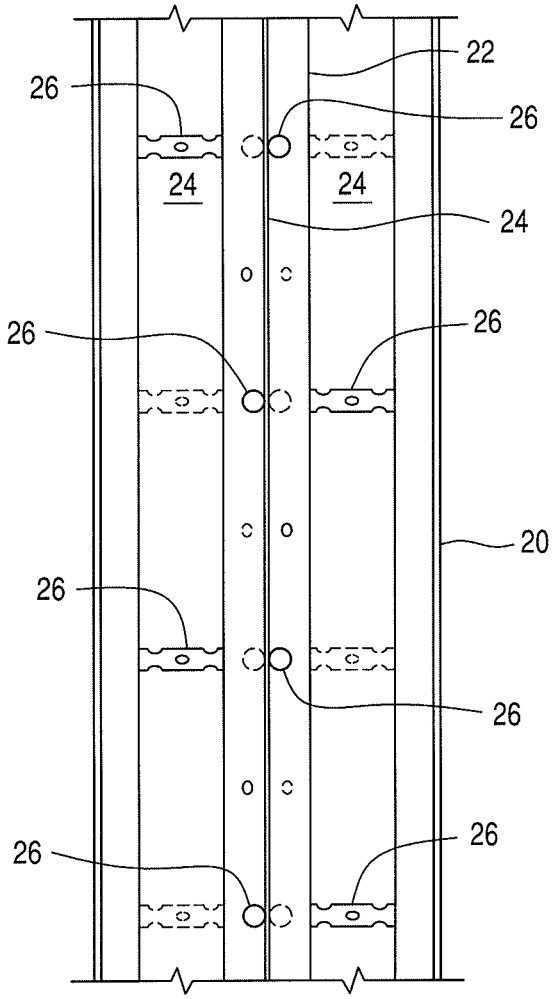
FIG. 1 is a cross sectional view of a steel concrete filled circular shaped tubular steel column in accordance with a first embodiment of the invention.
Figure 1A:
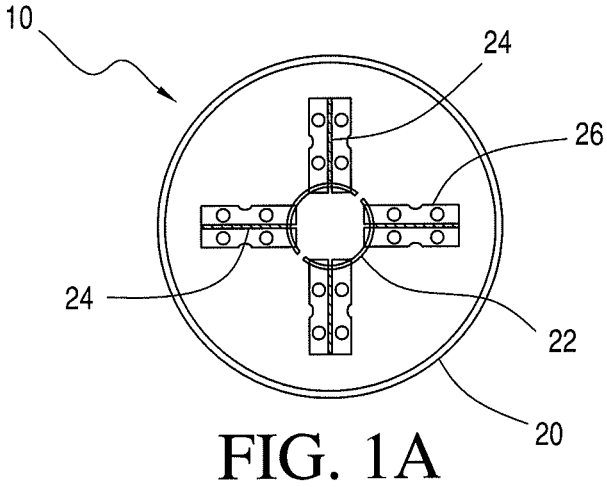
FIG. 1A is a plan view of the column shown in FIG. 1.
Figure 2:
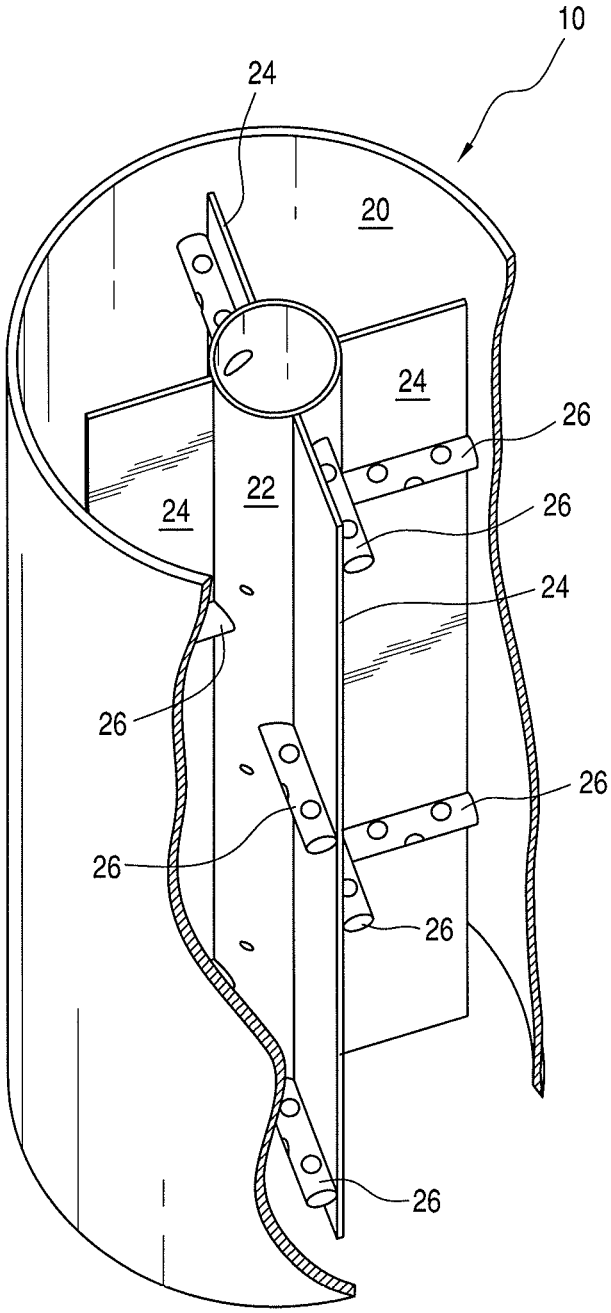
FIG. 2 is a perspective view of a portion of the column partially cut away of a relatively large size circular concrete-filled steel tubular column in accordance with a preferred embodiment of the invention.

In a preferred embodiment of the invention, as shown in FIGS. 1, 1A and 2 a centrally located perforated inner vertical tubular member 22 provides reinforcement for the column 10. Rebars and steel plates 24 can also be added for further reinforcement. The perforation of the pipes including the horizontal pipes 26 and the centrally disposed vertical tubular member 22 are all closed with a plurality of water resistant polymer caps for preventing the escape of water or mortar through the openings when the cement is in the plastic state. Further, the plastic caps are melted during a fire thus providing passage for the escape of gases through the pipes and up the inner vertical tubular member 22.

It should be recognized that the main source of casualties during fires is the inhalation of noxious gases and smoke which are reduced by the novel system disclosed herein. Such systems can channel the gases upwardly through the tubular member 22 from the concrete filled steel tubular column 10 to the outside of the building.

The inner steel pipes 26 and inner steel tubular member 22 also provide better means for the dissipation of heat of hydration of concrete particularly when high strength concrete is used. The inner pipes may also be used for passing chilled water for the purpose of dissipation of heat of hydration. Further, the inner vertical tubular member 22 and the perforated inner pipes 26 may be subsequently used for injecting cement grout through the perforations for strengthening the post fire damaged concrete.

One of the main advantages of the novel system of strengthening as compared to several other conventional methods is that it does not alter the size of the column and hence its esthetic appearance. The filling of space inside the inner steel pipe with cement grout would also provide additional strength after a fire with damage to the column 10.

A preferred embodiment of the invention will now be described with references to FIG. 1. As illustrated a concrete-filled steel tubular column 10 includes an outer longitudinally extending vertical tubular steel shell 20 that may be made of at least 12 gauge austenitic stainless steel for certain applications or lower carbon steel for other applications. In a preferred embodiment of the invention, the shell 20 has a minimum diameter of 300 mm as designed for structural consideration and loads.

The concrete-filled tubular steel column 10 also includes a perforated tubular steel member 22 that is centrally disposed within the outer longitudinally extending vertical steel shell 20 that is made of low carbon steel with a diameter that is suitable for grouting with a minimum of about 100 mm. The inner tubular steel member 22 based on the structural design of the column considering its load carrying capacity and may be kept as low as 12 gauge steel has a diameter of between about $1/8^{th}$ and $1/3^{rd}$ of the diameter of the outer longitudinally extending vertical steel shell 20.

The inner tubular steel member 22 also adds reinforcement to the column 10. Additionally reinforcement is provided by four flange like steel vertical plates 24 that extend outwardly from the inner tubular member 22. These plates 24 have a thickness based on the structural design of the column considering its load carrying capacity and may be kept as low as 12 gauge steel and are made of low carbon steel. The plates 24 are attached to the inner tubular member 22 by welding or other suitable means and extend outwardly nearly to but are at least spaced from the inner surface of the outer longitudinally extending vertical tubular shell 20.

In addition to the above, the column 10 also includes a plurality of horizontally disposed perforated pipes 26 disposed at regular vertical spacings. Each of the perforated pipes 26 include a plurality of openings with a diameter of about 40 mm and open inner and outer ends. The plurality of openings i.e. openings in the pipes have a diameter of about 20 mm. An inner end of each pipe is welded or otherwise fixed to the inner tubular steel member 22 with the open end aligned with an opening in the inner tubular steel member to allow gases generated during a fire to exit upwardly through the inner tube or member 22. The pipes 26 may also be welded or otherwise fixed to the vertical steel flange like plates 24.

For example, the perforated horizontal pipes 26 may be fixed to the vertical flanges 24 by one or more clips 31 as shown in FIG. 6 or other conventional attachment as for example for brazing, welding or the like. Soldering may not be appropriate if the temperature within the column would melt the solder or the like during a fire or during setting of the concrete.

A plurality of meltable plastic or adhesive tape or polymer caps of polyethylene, PVC or the like close each of the openings in the pipes 26 as well as the open outer ends of pipes 26 and the openings in the inner tubular steel member 22. These caps prevent water and concrete from entering the pipes through the openings when the concrete is in a plastic state and allows gases to escape in the event of fire when the plastic caps are melted due to heat from the fire.

A mass of concrete preferably high strength or ultra high strength fills the void between the outer longitudinally extending vertical tubular steel shell 20 and the inner tubular steel member 22 and engulfs the plates 24 and pipes 26. In the preferred embodiment of the invention the concrete is high strength or ultra high strength concrete.

As illustrated in FIGS. 3 and 3A a steel column 10 includes an outer longitudinally extending vertical steel shell 20 and a perforated inner tubular steel member 22. As shown in the inner tubular steel member 22 includes a plurality of openings 22' that are spaced from one another circumferentially and vertically and wherein the circumferentially spaced openings are vertically spaced from one another.

Another embodiment of the invention is shown in FIGS. 4 and 4A wherein an elliptical concrete-filled steel tubular column 11 includes an elliptical outer longitudinally extending vertical tubular steel shell 21 and an inner vertical circular tubular member 23. In this embodiment of the invention, a pair of vertical steel plates 25 are fixed to the inner tubular steel member in a similar manner to the plates in an earlier embodiment. A plurality of perforated pipes 27 extend outwardly from the circular inner steel tubular member 23.

A still further embodiment of the invention is shown in FIGS. 5 and 6 wherein plastic or polymer plugs 29 seal the openings in the inner vertical tubular member 22 or 23 and in the horizontal pipes 26 or 27 and a plastic or polymer plug 31 seals the end of the pipes 27. These plugs prevent plastic cement from entering the pipes 26 or 27 but melt when a fire engulfs the column 10. After a fire cement (grout) is pumped into the column through the inner steel tubular member 22 or 23 and pipes 26 or 27 to add strength to the column 10 or 11.

While the invention has been disclosed in connection with its preferred embodiments it should be recognized that changes and modifications may be made therein without departing from the scope of the claims.

What is claimed is:

1. A concrete-filled steel tubular column for high load carrying capacity, said column comprising an outer longitudinally extending vertical tubular steel shell and an inner steel tubular member disposed within said outer longitudinally extending vertical tubular shell and a plurality of spaced transverse flanges extending outwardly from said inner steel member and a plurality of horizontally disposed perforated pipes adjacent each of said flanges at regularly vertical spacings between said outer shell and said inner steel member for the escape of gases in the event of fire and a mass of concrete filling said void between said vertical tubular steel shell and said inner steel member and wherein said horizontal pipes fall short of said outer tubular steel shell.

2. A concrete-filled steel tubular column for high load carrying capacity according to claim 1 in which said inner steel member is centrally disposed within said outer longitudinally extending vertical tubular shell and wherein the area or volume between said outer steel tubular shell and said inner tubular member is filled with high strength concrete.

3. A concrete-filled steel tubular column for high load carrying capacity according to claim 1 in which said inner steel member is offset from center.

4. A concrete-filled steel tubular column for high load carrying capacity according to claim 1 in which said concrete is high strength concrete.

5. A concrete-filled steel tubular column for high load carrying capacity according to claim 1 in which said concrete is ultra high strength concrete.

6. A concrete-filled steel tubular column for high load carrying capacity according to claim 1 in which said outer shell has a circular cross sectional diameter of between about 300 mms to 900 mms.

7. A concrete-filled steel tubular column for high load carrying capacity according to claim 1 which includes four outwardly extending vertical flanges separated from one another by about 90°.

8. A concrete-filled steel tubular column for high load carrying capacity according to claim 1 in which said mass of concrete is mixed with plastic fibers.

9. A concrete-filled steel tubular column for high load carrying capacity, said column comprising:

an outer longitudinally extending vertical tubular steel shell and an inner perforated tubular steel member having a plurality of openings therein centrally disposed within said outer longitudinally extending tubular steel shell, a plurality of radially extending vertical flange like steel plates extending outwardly from said inner tubular steel member between said inner steel member and said outer longitudinally extending vertical tubular steel shell; and a plurality of horizontal perforated pipes having a plurality of openings therein disposed at regularly vertical spacings between said inner perforated steel member and said outer longitudinally extending vertical tubular steel shell for the escape of gases in the event of fire and a mass of concrete engulfing said flanges and said pipes and filling a void between said outer longitudinally extending vertical tubular steel shell and said inner perforated tubular steel member.

10. A concrete-filled steel tubular column for high load carrying capacity according to claim 9 in which said mass of concrete is high strength concrete.

11. A concrete-filled steel tubular column for high load carrying capacity according to claim 10 in which said plurality of radially extending steel flanges include four flanges spaced at 90° from one another.

12. A concrete-filled steel tubular column for high load carrying capacity according to claim 9 in which each of said outer shell and inner tubular steel member have a circular cross section.

13. A concrete-filled steel tubular column for high load carrying capacity according to claim 12 in which said outer longitudinally extending tubular steel shell has an elliptical cross section.

14. A concrete-filled steel tubular column for high load carrying capacity according to claim 12 in which said inner shell has a diameter of about one-third to one-eighth of the diameter of said outer shell.

15. A concrete-filled steel tubular column for high load carrying capacity according to claim 14 in which said inner shell has a diameter of about 100 mm and said outer shell has a diameter of about 300 mm.

16. A concrete-filled steel tubular column for high load carrying capacity according to claim 9 in which said outer shell has an elliptical cross section.

17. A concrete-filled steel tubular column for high load carrying capacity according to claim 9 in which said pipes have one open end and the opposite end connected to said inner tubular member with an opening therebetween and wherein the open inner ends of said pipes are fixed to said inner tubular steel member and the outer ends of said pipe end short of said tubular steel shell.

18. A concrete-filled steel tubular column for high load carrying capacity according to claim 9 which includes a plurality of polymer caps for closing said openings in said inner perforated tubular steel member and said horizontal perforated pipes and wherein said polymer caps are meltable in the event of an external fire to allow gases generated thereby to exit the column through the inner tubular member and out of the top of the column.

19. A concrete-filled steel tubular column for high load carrying capacity according to claim 9 in which said openings have a diameter of not less than 13 mm.

20. A concrete-filled steel tubular column for high load carrying capacity, said column consisting of:

an outer longitudinally extending vertical tubular steel shell having a circular cross section with an outer diameter of between about 300 to 900 mms; and an inner perforated tubular steel member centrally disposed within said outer longitudinally extending tubular steel shell and having a circular cross section with a diameter suitable for grouting;

four radially extending vertical flanges extending outwardly from said inner perforated tubular steel member at about 90° from one another and between said inner perforated tubular steel member and said outer longitudinally extending vertical tubular steel shell; and a plurality of horizontal perforated pipes having an outer diameter of about 40 mm each with a plurality of openings with diameters of about 20 mms and wherein an open end of each pipe is fixed to said inner perforated tubular steel member with an opening therebetween disposed at regularly vertical spacings adjacent said flanges;

a plurality of meltable polymer caps covering said openings in said inner perforated tubular steel member and said pipes and wherein said caps are meltable in the event of an external fire;

a plurality of rebars disposed between said outer longitudinally extending vertical shell and said inner perforated tubular steel members; and a mass of high strength concrete engulfing said flanges, said pipes and said rebars and filling a void between said outer longitudinally extending vertical tubular steel shell and said inner perforated tubular steel member.

* * * * *